US005852831A

United States Patent [19]

Naughton et al.

[11] Patent Number: 5,852,831

[45] Date of Patent: Dec. 29, 1998

[54] SELF-CLOSING TOILET SEAT AND LID

[76] Inventors: Donald G. Naughton, 8550 Katy Freeway, Suite 126, Houston, Tex. 77024; Malcolm E. Smith, 1636 Birdsong Pl., El Cajon, Calif. 92021

[21] Appl. No.: 880,752

[22] Filed: Jun. 23, 1997

[51] Int. Cl.[6] ..... A47K 13/12

[52] U.S. Cl. ..... 4/236; 4/240; 4/248

[58] Field of Search ..... 4/236, 240, 246.1, 4/248

[56] References Cited

U.S. PATENT DOCUMENTS

| | | | |
|---|---|---|---|
| 1,993,625 | 3/1935 | Riemer et al. | 4/248 X |
| 4,551,866 | 11/1985 | Hibbs | 4/251 |
| 4,912,783 | 4/1990 | Shafer | 4/251 |
| 4,995,120 | 2/1991 | Tager | 4/251 |
| 5,165,507 | 11/1992 | Ohshima | 4/236 X |
| 5,267,356 | 12/1993 | Gideon et al. | 4/248 X |
| 5,349,703 | 9/1994 | Mocilnikar et al. | 4/250 |
| 5,388,281 | 2/1995 | Wiklund et al. | 4/248 |
| 5,487,192 | 1/1996 | Hodges | 4/246.3 |
| 5,504,947 | 4/1996 | Robello et al. | 4/246.1 |
| 5,546,612 | 8/1996 | Johnson | 4/248 |
| 5,724,683 | 3/1998 | Sorimachi et al. | 4/248 |

*Primary Examiner*—Charles E. Phillips
*Attorney, Agent, or Firm*—Frank G. Morkunas

[57] ABSTRACT

An improved toilet seat having a flush device, a bowl mount, a seat and a lid each having at least one locking member and a hinge pin pivotally holding the seat and lid to the bowl mount, a braking means for the seat and lid, the braking means being substantially tapered at one end, spiral-shaped from the tapered end, and substantially flat and resilient and adapted to friction grip the respective seat and lid hinge pins as either or both descend to a closed position, and closure initiating means adapted to move the toilet seat from an upright resting position when the toilet is flushed to a point substantially beyond a vertical center such that the natural weight of the toilet seat causes the toilet seat to descend whereupon the respective tapered ends friction grip the respective seat and lid hinge pins and coil and tighten therearound thereby braking the natural descent of the toilet seat while permitting the toilet seat to close.

17 Claims, 4 Drawing Sheets

SELF-CLOSING TOILET SEAT AND LID

CROSS REFERENCES TO RELATED APPLICATIONS

Not applicable

STATEMENT REGARDING FEDERALLY-SPONSORED RESEARCH OR DEVELOPMENT

Not applicable

BACKGROUND OF THE INVENTION

This present invention relates to a device for the automatic lowering of a toilet seat and lid.

Toilet seat lid and seat raising and lowering devices of various designs and configurations are well-known in the prior art. Numerous such devices have been constructed and used for the purpose of lowering toilet seats and lids; and, in some cases for also raising toilet seats and lids. These configurations consist primarily of familiar and obvious structural configurations in the obviously crowded prior art which abounds. Some of the prior art includes:

U.S. Pat. No. 5,388,281 issued to Wiklund, et.al., discloses a toilet seat having a mechanism for automatically lowering the seat after a time interval in the raised position. This mechanism has a hydraulic section and a dry-spring section contained within a hollow rotor which is constructed as part of the rear of the toilet seat. The time interval is the result of fluid escaping from the hydraulic mechanism (referred to as the dashpot). The coil spring provides the energy to urge the seat downward after the time interval has passed. Fluid pressure and valves dampen the closing so that the seat descends slowly to the closed position. This mechanism is constructed such that it can be adapted to existing toilet seats to provide an unobtrusive closing mechanism to existing fixtures.

U.S. Pat. No. 5,546,612 issued to Johnson discloses an automatic toilet seat lowering device integrated into a seat hinge assembly. Initial lowering action results after a coiled spring is released causing the seat to free fall for a partial distance. Descent is controlled thereafter by a friction caused between a combination of rotating and non-rotating brake discs mounted within the device. Interaction between these brake discs, the compression of a disc spring, and a reverse resistance on a torsion spring within the device serve to slow the initial free fall of the seat into a controlled soft landing to the seat's resting place.

Other patents include U.S. Pat. No. 4,551,866 to Hibbs (utilizing an operating cylinder and a piston); U.S. Pat. No. 4,912,783 to Shafer (utilizing a torsional coil spring, dampening cylinders, and a circumferential groove for engagement with a spring biased locking pin); U.S. Pat. No. 4,995,120 to Tager (utilizing an electric motor, a ratchet clutch mechanism, and a timer); U.S. Pat. No. 5,349,703 issued to Mocilnikar, et.al. (utilizing a toothed sprocket which engages a rotatable sleeve having corresponding teeth); U.S. Pat. No. 5,487,192 issued to Hodges (utilizing a manually operated control lever for raising and lowering a toilet seat); and U.S. Pat. No. 5,504,947 issued to Robello, et.al. (utilizing an air controlled cylinder secured to a toilet bowl and seat).

Each of these prior art patents have attempted to solve a long-felt problem; automating the lowering of a toilet seat and lid whether singly or in combination in a most efficient, effective, and inexpensive means with the least amount of moving parts while preserving the aesthetics of the surroundings to the extent practicable. None of the prior art patents has accomplished each of these objects and objectives.

It is a general object of this invention to provide a low-cost, trouble-free lowering mechanism for toilet lids and seats which consists of few moving parts to effect the lowering operation.

It is a further general object of this invention to provide a toilet lid and seat lowering mechanism which can be easily maintained and repaired with easy-to-remove and replace parts.

It is a yet further general object of this invention to provide a toilet lid and seat lowering mechanism which is unobtrusive in operation or appearance.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates an improved toilet seat for a toilet having a flush device; a bowl mount having at least two mounting lugs; a seat having at least one seat lug and at least one seat locking member; a lid having at least one lid lug and at least one lid locking member; a seat hinge pin pivotally connecting said seat to said bowl mount through one of said at least one seat lug and one of said at least two mounting lugs, said seat attached in pivoting communication with said seat hinge pin by said at least one seat locking member; a lid hinge pin pivotally connecting said lid to said bowl mount through one of said at least one lid lug and the other of said at least two mounting lugs, said lid attached in pivoting communication with said lid hinge pin by said at least one lid locking member; seat brake means, said seat brake means having a seat brake first end and a seat brake coupler, said seat brake means being substantially tapered at said seat brake first end and substantially resilient and substantially spiral-shaped, said tapered end adapted to friction grip said seat hinge pin as said seat descends to a closed position; and closure initiating means attached to said toilet seat adapted to move the toilet seat from an upright resting position when the toilet is flushed to a point substantially beyond a vertical center such that the natural weight of the toilet seat causes the toilet seat to descend, such that, as the toilet seat descends, the seat brake tapered end friction grips the seat hinge pin and substantially coils and tightens therearound thereby braking the natural descent of the toilet seat but permitting the toilet seat to close.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which.

DETAILED DESCRIPTION OF THE INVENTION

Figure 1:
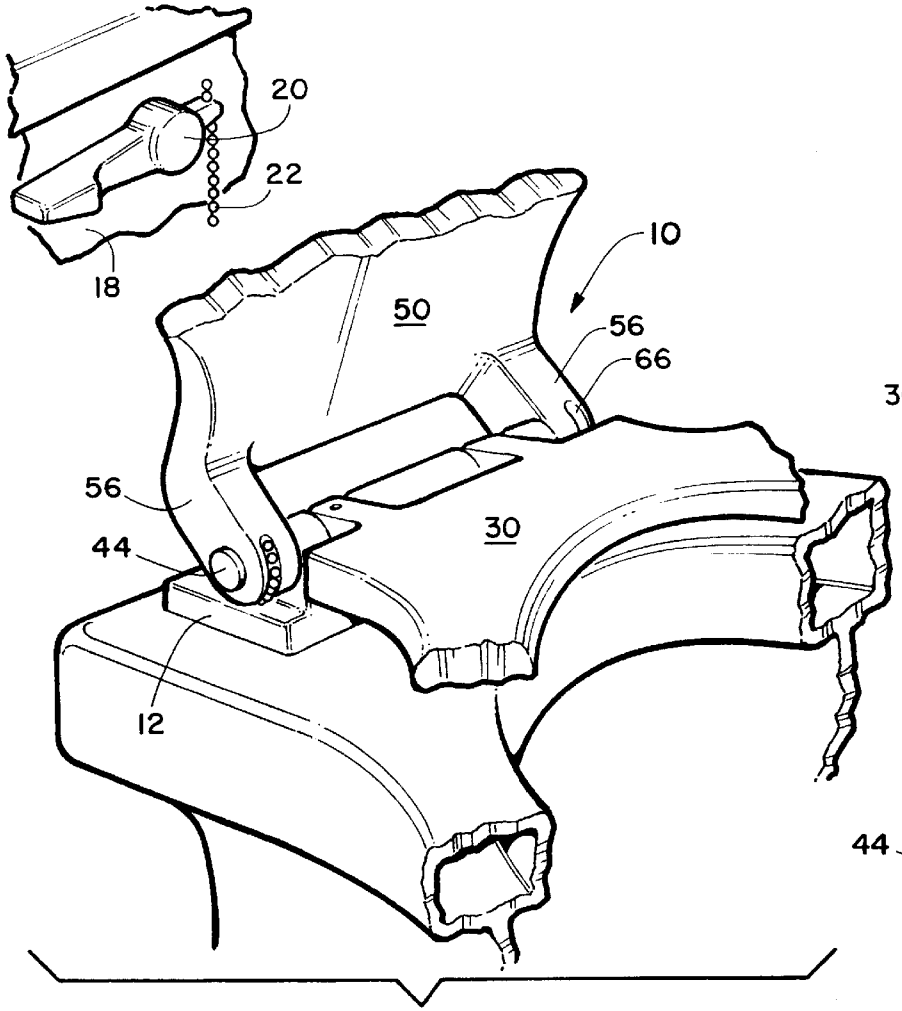
FIG. 1 is an exploded sectional view of the toilet seat and flush device.
Figure 2:
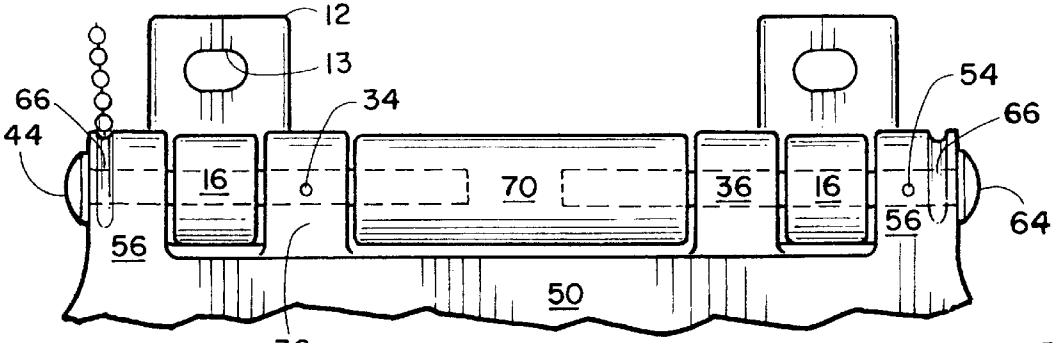
FIG. 2 is a sectional plan view of lid and seat.
Figure 3:
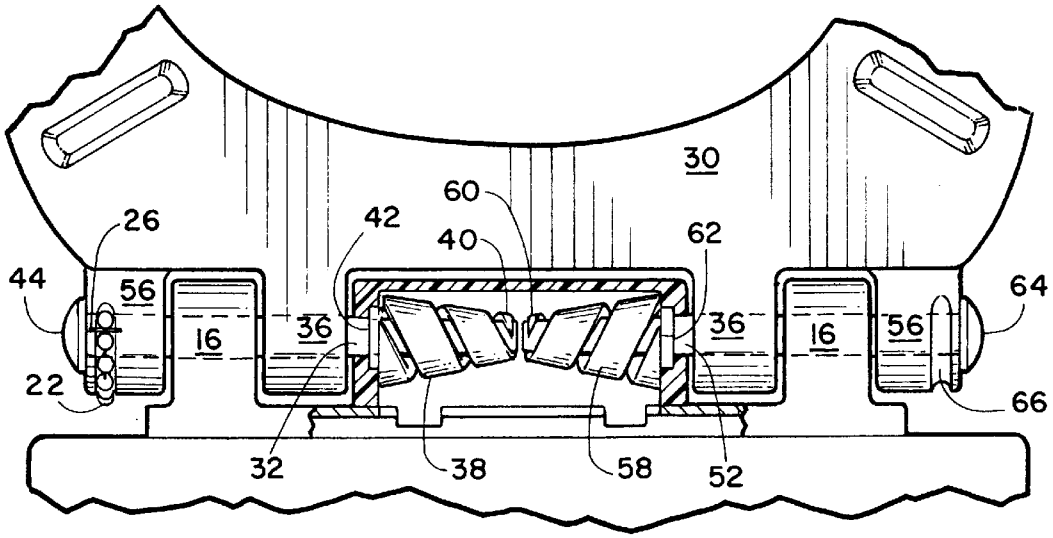
FIG. 3 is a sectional front view of the lid and seat with the braking mechanism exposed.

Referring now to the drawings in detail and in particular to FIG. 1, reference character 10 generally designates a toilet seat combination constructed in accordance with a preferred embodiment of the present invention. The toilet seat 10 has a seat 30 and a lid 50. The seat 30 has at least one seat lug 36. Two such lugs are preferred although more may be used. The lid 50 has at least one lid lug 56. Two such lugs are also preferred although more may be used. The seat 30 and lid 50 are mounted together by way of mounting lugs 16 which are on bowl mount 12. Each of the lugs has an aperture through which a respective hinge pin is inserted. In FIGS. 2 and 3, the respective hinge pins are revealed in phantom lines. A flush device 20 is attached to a toilet tank 18.

Seat hinge pin 32 has a head 44 at its outer end. In this case seat hinge pin 32 inserts through lid lug 56 by its inner end, then through one mounting lug 16, and finally through and passed seat lug 36. The inner end comes to rest substantially at the mid-point between each of the mounting lugs 16. Seat lug 36 has seat lug aperture 35 on top which aligns with seat hinge aperture (not shown) when seat hinge pin 32 is fully inserted. A seat locking member 34, such as a pin, is placed through the seat lug aperture 35 and the aperture of the seat hinge pin 32. This connects the seat 30 to the seat hinge pin 32 in a locked pivotally communicating manner such that each moves in tandem.

The lid 50 is attached in similar fashion. Lid hinge pin 52 has a head 64 at its outer end. In this case lid hinge pin 52 inserts first at the opposite side of the bowl mount 12 through lid lug 56 by its inner end, then through the other mounting lug 16, and finally through and passed seat lug 36. The inner end comes to rest substantially at the mid-point between each of the mounting lugs 16 and adjacent to the seat hinge pin 32. Lid lug 56 has lid lug aperture 55 on top which aligns with lid hinge aperture (not shown) when lid hinge pin 52 is fully inserted. A lid locking member 54, such as a pin, is placed through the lid lug aperture 55 and the aperture of the lid hinge pin 53. As in the case with the seat 30, this connects the lid 50 to the lid hinge pin 52 in a locked pivotally communicating manner such that each moves in tandem, yet the seat 30 and lid 50 are capable of moving independently of one another.

FIGS. 2 through 6 illustrates the crux of the lowering mechanism, a substantially flat, spiral-wound, resilient band inserted over the respective hinge pins. FIG. 2 illustrates substantially how the toilet seat combination 10 appears from its plan view in a closed position with all structural elements in place. FIG. 3 shows the toilet seat combination 10 as viewed from the front with the lid and seat up and the inner braking mechanisms within the housing 70 exposed to view. The seat brake 38 and the lid brake 58 are adjacent to one another and comprise the braking structure for each of the respective hinge pins. The seat brake 38 has a substantially tapered seat brake first end 40 adjacent to the inner end of the seat hinge pin 32 and a seat brake coupler 42 and the opposite end. The flat band on the seat brake spirals clockwise from its tapered end 40 to the seat brake coupler 42 where the band is fixedly connected. The band is not fixedly connected at its tapered end 40 but rests on the seat hinge pin 32. The band can be made of any resilient material possessing a minimal co-efficient of friction. The seat brake coupler 42 is shaped in such a fashion that it will fit only in one end of the housing 70 which covers the bowl mount 12. This will be described later.

On the adjacent side, the lid hinge pin 52 is likewise covered with a lid brake mechanism 58. The lid brake mechanism 58 has a substantially tapered lid brake first end 60 adjacent to the inner end of the lid hinge pin 52 and a lid brake coupler 62 on the opposite end. The flat band on the lid brake also spirals from its tapered end 60 to the lid brake coupler 62 where the band is fixedly connected. The key difference between the lid brake 58 and the seat brake 38 is that the lid brake 58 spirals in a counter-clockwise fashion. Like its counterpart brake mechanism, the band is not fixedly connected at its tapered end but rests on the lid hinge pin 52. Also like its counterpart, the band can be made of any resilient material possessing a minimal co-efficient of friction. The lid brake coupler 62 is shaped in such a fashion that it will fit only in one end of the housing 70 which covers the bowl mount 12. It cannot fit into the area shaped for the seat brake coupler 42.

Figure 4:
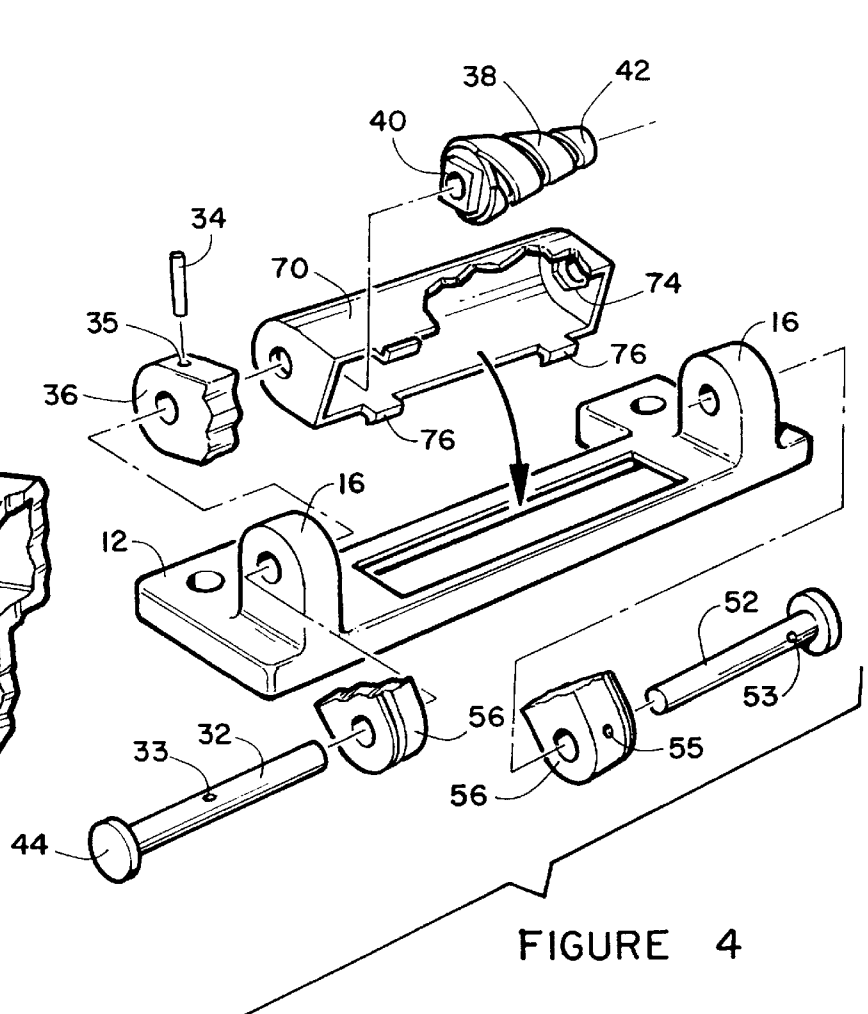
FIG. 4 is an exploded view of the housing which holds the braking mechanism.

FIG. 4, illustrates in greater detail the configuration and construction of the bowl mount 12, the housing 70, and the respective seat and lid brake mechanisms. The housing 70 is removable from the bowl mount 12. It however fits securely in place and is held there by corresponding ribs and slots or detents on the bowl mount 12 and the housing 70. Any suitable securing means as represented by reference character 76 in FIG. 2 may be used for this purpose and, in the case of ribs and slots, either member, the bowl mount 12 or the housing 70, can be configured to have the rib or the slot. The rib or slot may be in the inner or outer surface of the bowl mount 12 or on the inner or outer surface of the housing, provided the respective rib and slot correspond in a securing manner with one another. The purpose here is that the housing 70 is held securely to the bowl mount 12 and that it may also be removable.

Figure 6:
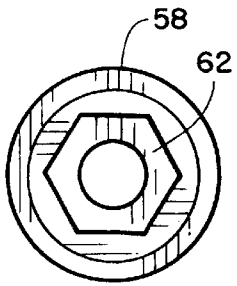
FIG. 6 is side elevation view of the non-tapered end of the braking mechanism.
Figure 5:
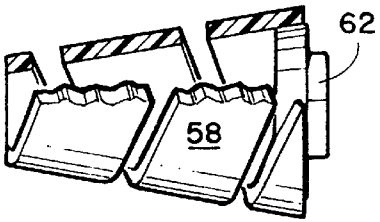
FIG. 5 cut-out view of the braking mechanism.

Housing 70 has a recessed second end 74 and a recessed first end 72 (not shown in this figure). Each recessed end is geometrically shaped differently from the other recessed end. Each recessed end is shaped to receive a mating brake coupler and no other. In FIG. 4, seat brake coupler 42 is shown to be substantially squared and protruding. It fits into recess first end 72 (not shown) which is similarly shaped and mates with seat brake coupler 42. Recess second end 74 is shown to be shaped hexagonally. It mates with and receives lid brake coupler 62 as shown in FIGS. 5 and 6. Each coupler seats securely, but removably, in the respective housing recess ends. Once so seated, the housing 70 is secured to the bowl mount 12. The respective hinges are inserted through the respective lugs and previously described and held thereto by their respective locking pins. Reversing the process permits removal of the seat 30, the lid 50, the seat hinge pin 32, the lid hinge pin 52, the seat brake 38, and the lid brake 58. As the respective brakes wear, they may be replaced.

With the toilet seat combination so configured, from a closed (down) position, lid 50 alone or seat 30 and lid 50 may be lifted and set to rest against the back of a toilet tank 18. Because of the manner in which the respective brake mechanisms are wound, the tapered ends offer no resistance and attempt to, but do not, un-coil with the lifting of the lid 50 or the seat 30 and lid 50 in tandem. Movement in the opposite direction (downward) causes the tapered ends of each brake mechanism to grab the respective hinge pin as it rotates, tighten its coil, and grip the hinge pin more tightly and slow down the descent but not stop it. The grip at the tapered end, though tight, nonetheless permits slippage of the hinge pin in a slow descent. A closing, or descent, is initiated by a closure initiating means attached to the flush device 20. Closing is initiated after the toilet is flushed by the flush device 20.

Figure 8:
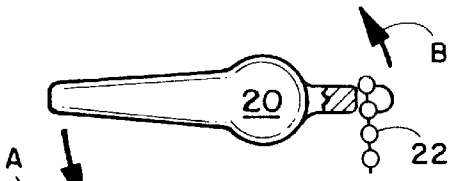
FIG. 8 is the flush device for use with the closure initiating mechanism of FIG. 3.
Figure 7:
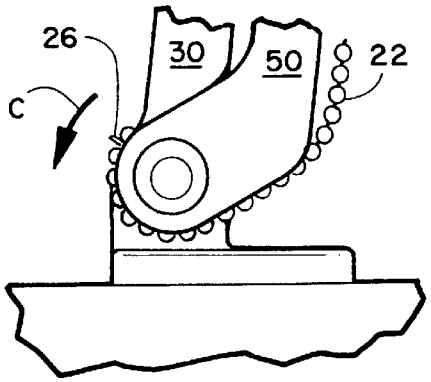
FIG. 7 is a side sectional view of the lid and seat in an upright position.

A typical closure initiating means is shown in FIGS. 7 and 8. In this embodiment, a bead chain 22 is attached by one end to a flush device 20. The bead chain 22 is wrapped and channeled around a slot 66 which is in the lid lug 56 where its other end is attached to a activator 26 which is also connected to the lid lug 56. As so configured, when flush device 20 is pulled in the direction of arrow A, the bead chain moves in the direction of arrow B, causing the activator to move in the direction of arrow C. Movement by the activator 26 in this direction precipitates a tandem movement of the lid 50 toward closure. The length of bead chain 22 is such that it causes the lid 50 to move past its vertical equilibrium whereupon the force of gravity forces the lid 50 completely downward. The rate of descent is interrupted by the friction gripping of the respective braking mechanisms contained within the housing as previously described.

Figure 10:
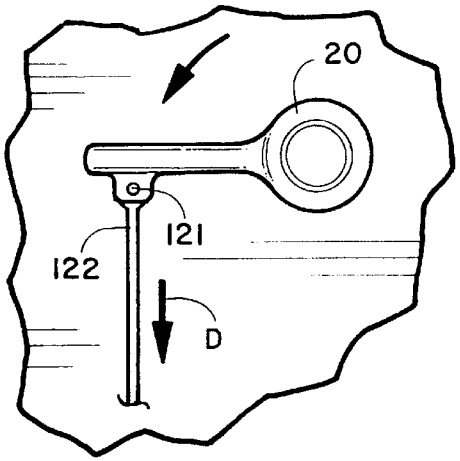
FIG. 10 is the flush device used in conjunction with the closure-initiating mechanism of FIG. 9.
Figure 9:
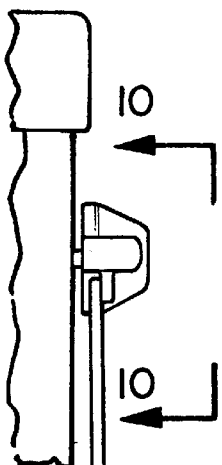
FIG. 9 is a side elevation sectional view of another embodiment of the closure-initiating mechanism.
Figure 9:
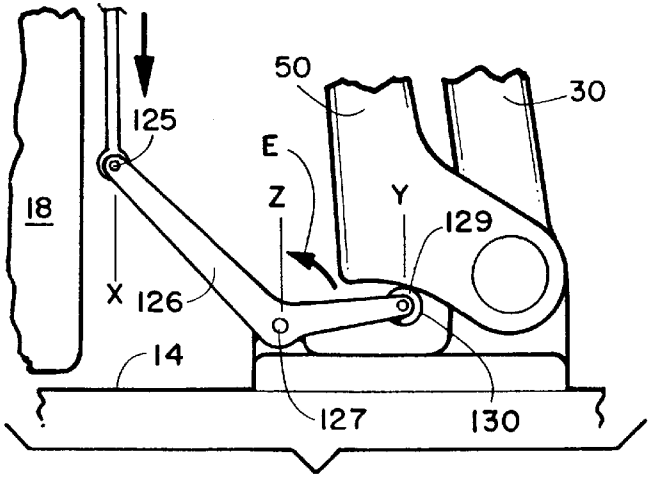

Yet another embodiment of the closure initiating means is shown in FIGS. 9 and 10. The flush device 20 has a push rod 122 connected thereto by a flush pivot member or pin 121. At the opposite end of the push rod is a push rod lever 126. The push rod lever 126 is pivotally connected to the push rod 122 by the push rod member or pin 125. At the opposite end of the push rod lever 126 is push rod lever end 130 at which a rotatable push rod lever roller is attached. With X representing substantially the central location of the push rod member or pin 125 and Y representing substantially the central location of the push rod lever roller 129, the location of the push rod member or pin 127 is represented by Z. Location Z is at a point substantially 10 to 50 percent of the total distance attributed to X and Y. At this point the push rod lever 126 is pivotally connected to the bowl mount 12 by the mount pivot member or pin 127. Also at, and from this location, up to the push rod lever end 130, the push rod lever is substantially angled between about 90 to 165 degrees.

In operation then, as the flush device 20 is pushed downwards, the push rod 122 travels in the direction as indicated by arrow D which pushes down on the push rod lever 126. Because of its pivotable attachment at the mount pivot member or pin 127, the push rod lever end 130 moves in the direction of arrow E moving the lid 50 past the vertical equilibrium point whereupon, by gravitational forces, it descends to a closed position. The braking system described above then overtakes and controls the remainder of the descent.

Figure 12:
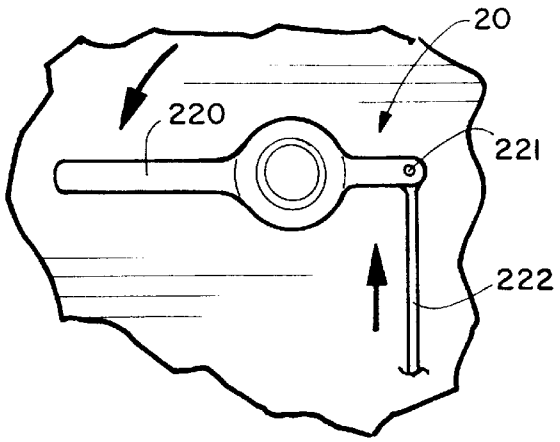
FIG. 12 is the flush device for use with the closure-initiating mechanism of FIG. 11.
Figure 11:
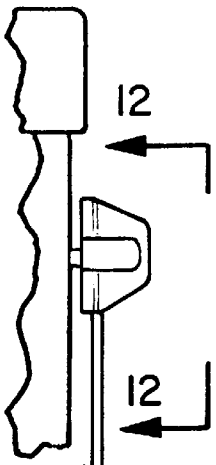
FIG. 11 is a side elevation sectional view of another embodiment of the closure-initiating mechanism.
Figure 11:
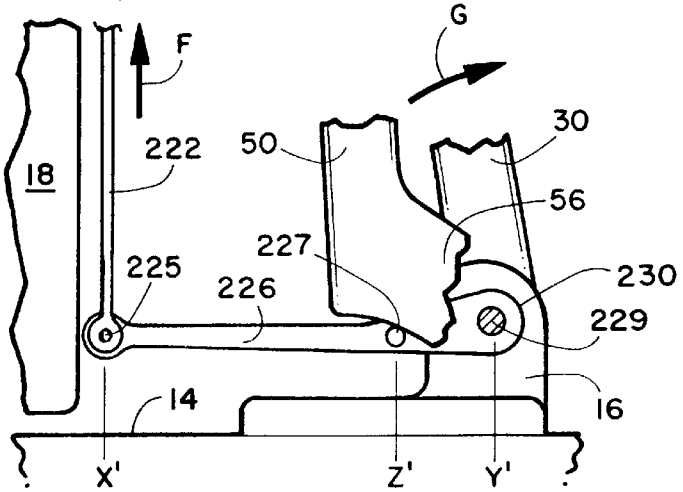

Yet another embodiment of the closure initiating means is shown in FIGS. 11 and 12. This embodiment utilizes a flush device having a flush handle 220 on one end and a handle stem 221 on the opposite end. A pull rod 222 is connected to the handle stem 221. At the opposite end of the pull rod 122 is a pull rod lever 226. The pull rod lever 226 is pivotally connected to the pull rod 222 by the pull rod member or pin 225. At the opposite end of the pull rod lever 226 is pull rod lever end 230 which has a pull rod lever orifice 229 thereat.

The pull rod lever 226 is pivotally attached to the toilet seat combination through its orifice 229 by a suitable hinge member or pin 32 or 52. The pull rod lever end 230 seats between a mounting lug 16 and a lid lug 56, the suitable hinge member or pin 32 or 52 holds the pull rod lever in place. A pull rod lever arm 227, extending substantially outward of the pull rod lever 226, is attached to the pull rod lever 226. With X' representing substantially the central location of the pull rod member or pin 225 and Y' representing substantially the central location of the pull rod lever orifice 229, the location of the pull rod lever arm 227 is represented by Z'. Location Z' is at a point substantially 10 to 50 percent of the total distance attributed to X' and Y'.

In operation then, as the flush handle 220 is pushed downward, the handle stem 221 travels upward causing the pull rod 222 to travel in the direction indicated by arrow F. This movement pulls up on the pull rod lever 226. Because of its pivotable attachment of the pull rod lever 226 to a hinge, the pull rod lever 226 moves upward, bringing with it the pull rod lever arm 227. The substantially outwardly extended pull rod lever arm 227 engages the lid 50, and while still moving upward, causing the lid to move in the direction of arrow G, pass its vertical equilibrium point whereupon it gravitationally descends to a closed position. The braking system described above then overtakes and controls the remainder of the descent.

Figure 13:
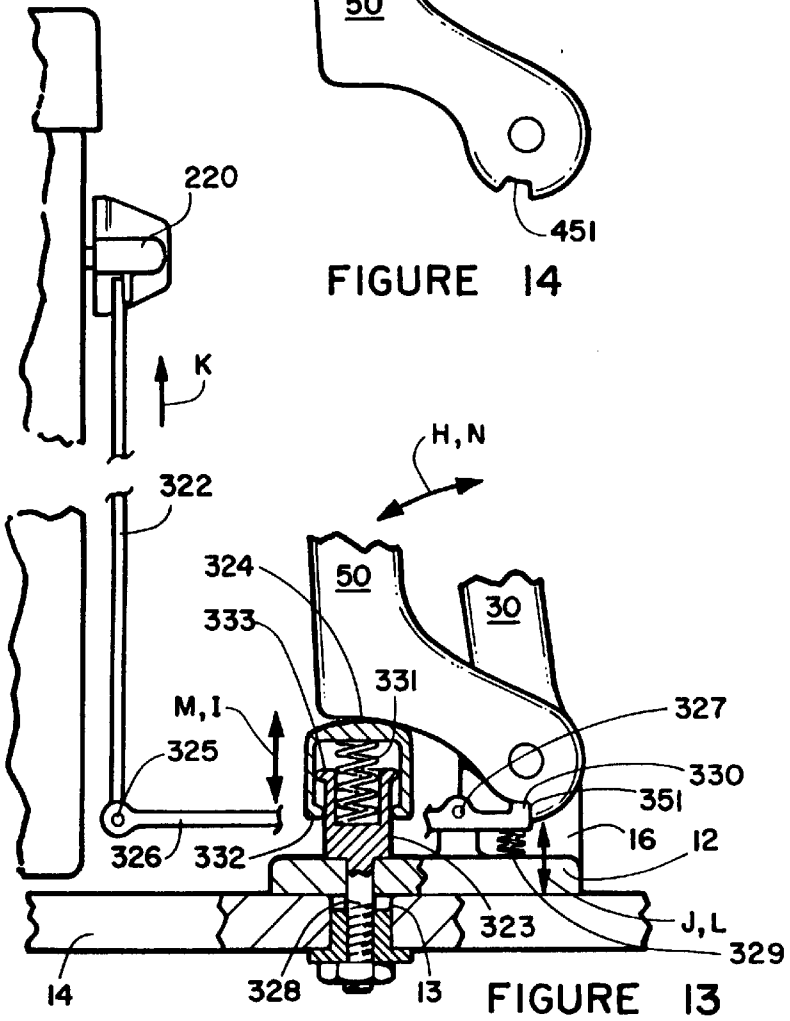
FIG. 13 is a side elevation, partially cut-away, sectional view of another embodiment of the closure-initiating mechanism.

A third embodiment of the closure initiating means is shown is FIG. 13. This embodiment is similar to the previous embodiment wherein the flush device pulls on the closing activator. A crank rod 322 is attached to the flush device at one end and to the crank 326, by the crank member or pin 325, at the other end. The crank 326 extends towards and engages the lid 50 at the crank end 330. The crank end 330 is substantially angled to about 90°. A crank pivot member or pin 327 is located at a point, as measured from the crank end 330, which is approximately 10 to 50 percent of the total length of the crank.

At a point substantially between the crank pivot member or pin 327 and the crank end 330, and below the crank 326, is a first tension means, such as a spring, exerting upward force on the crank 326, represented by direction arrows J,L with J representing the upward pointing arrowhead and L representing the downward pointing arrowhead. The crank pivot member or pin 327 is pivotally connected to the bowl mount 16. A second tension means is seated in the bowl mount orifice 13 of the bowl 14. The second tension means has a cup 323 and a moveable and removable cap 324 thereon. The cup 323 has a stem 328 extending downward and through the bowl mount orifice 13. The stem 328 may be threaded, smooth, and/or tapered.

The stem 328 is retained on the bowl 14 by a suitable fastener such as, but not limited to, a threaded nut, a toothed washer, a pin, a locking cap, or similar fastener suited for the intended purpose. A spring 331 is seated inside the cup. The spring 331 rests on the bottom of the cup 323 and extends upwards to the top of the inside portion of the cap 324 such that, in its uncompressed state, the spring 331 forces the cap 324 away from the cup 323 and causes the cap lip 332 to rise in abutting relationship with the cup ring 333. The cup ring 333, in conjunction with the cap lip 332, retains the cap 324 on the cup 323.

Figure 14:
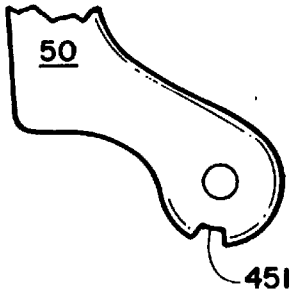
FIG. 14 is another embodiment of the lid-holding detent.

In FIG. 13, directional arrows H,N represent the raising and lowering motions, respectively, of the lid 50. Directional arrows M,I represent the upward and downward motions, respectively, of the cap 324. As the lid 50 is raised it travels in the direction of arrow H and, in the process, it forces the cap 324 to move downward in the direction of arrow I. As the lid attains its substantially vertical upright position, the crank bias 329 forces the crank upward in the direction of arrow J. A step 351 or detent 451 (as shown in FIG. 14) captures the crank end 330 and holds the lid 50 in its substantially vertical position preventing the upward forces of the cap bias 331 from forcing the lid 50 downward.

As flushing is initiated, the crank rod 322 moves in the direction of arrow K with a resultant movement of the crank end 330 in the direction of arrow L. This movement releases the lid 50 from the step 351 or detent 451 which held the lid 50 in that position. The forced retention of the compressed cap bias 331 is released causing the cap 324 to travel in the direction of arrow M which pushes on the lid 50 causing movement thereof in the direction of arrow N. This latter movement is sufficient to move the lid 50 past its vertical equilibrium causing its gravitational descent until the braking system described above overtakes and controls the remainder of the descent.

Figure 15:
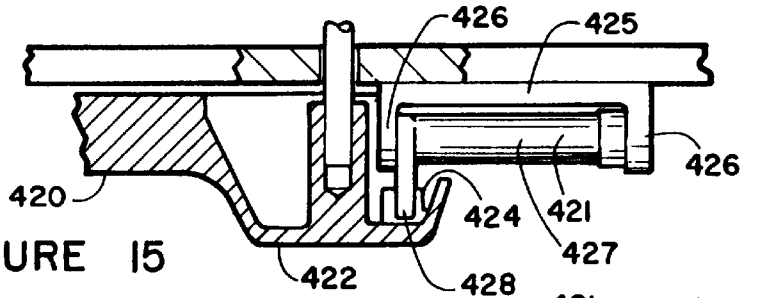
FIGS. 15–16 show a cut-away plan view of another embodiment of a closure-initiating mechanism in the flush device.
Figure 16:
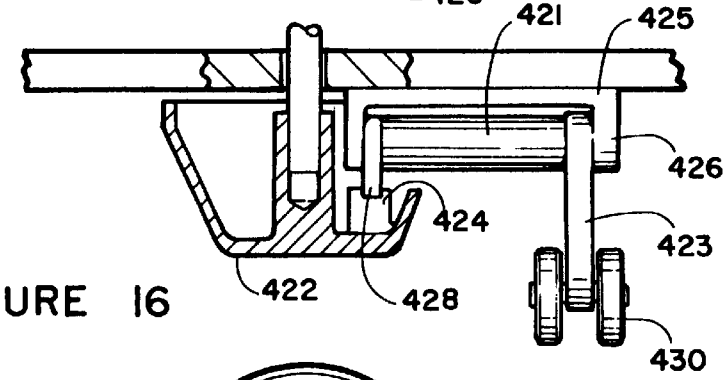
Figure 17:
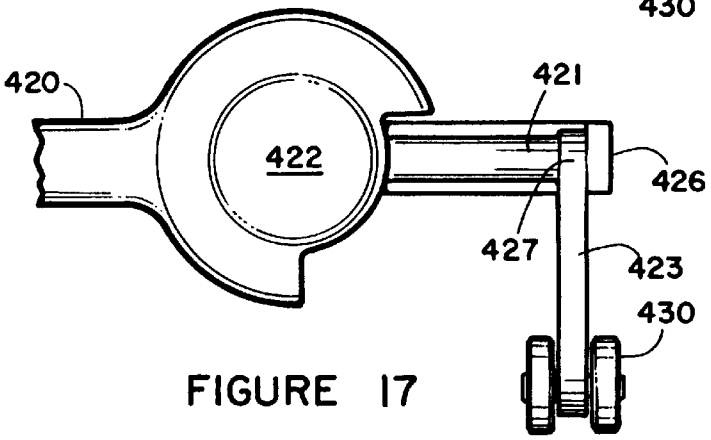
FIG. 17 is a partial front view of the closure-initiating flush device.

A fourth embodiment entails the use of a differently structured flush handle assembly as shown in FIGS. 15–17. This assembly has a flush handle 420 which has a handle cap 422. Within the handle cap 422, is a handle lobe 424. The handle lobe 424 is substantially radial or convex. Opposite the flush handle 420 is a substantially horizontally disposed handle base 425 connected to the tank 18. The handle base 425 has two base ends 426 on both ends. Pivotally fitted within the two base ends 426 is a handle rod 427. The handle rod 427 has a first arm 421 extending substantially horizontally from one base end to the other base end. At the base end which is contained within the handle cap, the first arm 421 has a rod nub 428. The rod nub 428, like the handle lobe 242, is substantially radial or convex. At the opposite base end, the handle rod 427 has its second arm 423 extending substantially downward terminating with a handle roller 430. The rod nub 428 is in communication with the handle lobe 424. The handle roller 430 is in communication with the lid (not shown in this figure). Handle pivot pins 429 pivotally retain the handle rod 427 within the handle base 425.

When flushing is initiated, the movement of the flush handle 420 causes the handle cap 422 to rotate counterclockwise. With this rotation, the handle lobe 424 comes into communication with the rod nub 428 causing the rod nub 428 to move upward. This upward movement forces the handle rod 427 to move, and particularly, the handle roller 430 to move outward from the toilet tank (not shown), engage the lid 50, and push it past its vertical equilibrium point causing the gravitational descent thereof until the braking described above overtakes and controls the remainder of the descent.

The present disclosure includes that contained in the present claims as well as that of the foregoing description. Although this invention has been described in its preferred forms with a certain degree of particularity, it is understood that the present disclosure of the preferred form has been made only by way of example and numerous changes in the details of construction and combination and arrangement of parts and method steps may be resorted to without departing from the spirit and scope of the invention. Accordingly, the scope of the invention should be determined not by the embodiemnt[s] illustrated, but by the appended claims and their legal equivalents.

The invention claimed is:

1. An improved toilet seat for a toilet having a flush device, wherein the improvement comprises:

a bowl mount having at least two mounting lugs;

a seat having at least one seat lug and at least one seat locking member;

a lid having at least one lid lug and at least one lid locking member;

a seat hinge pin pivotally connecting said seat to said bowl mount through one of said at least one seat lug and one of said at least two mounting lugs, said seat attached in pivoting communication with said seat hinge pin by said at least one seat locking member;

a lid hinge pin pivotally connecting said lid to said bowl mount through one of said at least one lid lug and the other of said at least two mounting lugs, said lid attached in pivoting communication with said lid hinge pin by said at least one lid locking member;

seat brake means, said seat brake means having a seat brake first end and a seat brake coupler, said seat brake means being substantially tapered at said seat brake first end and substantially resilient and substantially spiral-shaped, said tapered end adapted to friction grip said seat hinge pin as said seat descends to a closed position; and closure initiating means attached to said toilet seat adapted to move the toilet seat from an upright resting position when the toilet is flushed to a point substantially beyond a vertical center such that the natural weight of the toilet seat causes the toilet seat to descend, whereby, as the toilet seat descends, the seat brake tapered end friction grips the seat hinge pin and substantially coils and tightens therearound thereby braking the natural descent of the toilet seat but permitting the toilet seat to close.

2. The device as defined in claim 1 further having a housing detachably connected to said bowl mount, said housing having housing retaining means and a substantially recessed first end and a substantially recessed second end.

3. The device as defined in claim 2 wherein said housing retaining means comprises a cooperating slot and rib on said bowl mount and said housing.

4. The device as defined in claim 2 wherein said seat brake coupler is adapted to removably and non-rotatably set into said housing recessed first end.

5. The device as defined in claim 2 further having a lid brake means, said lid brake means having a lid brake first end and a lid brake coupler, said lid brake means being substantially tapered at said lid brake first end and substantially resilient and substantially spiral-shaped, said tapered end adapted to friction grip said lid hinge pin as said lid descends to a closed position.

6. The device as defined in claim 5 wherein said lid brake coupler is adapted to removably and non-rotatably set into said housing recessed first end.

7. The device as defined in claim 5 wherein said lid brake means spirals in a counter-clockwise direction as viewed from said lid brake first end.

8. The device as defined in claim 1 wherein said seat brake means spirals in a substantially clockwise direction as viewed from said seat break first end.

9. The device as defined in claim 1 wherein said seat hinge pin and said lid hinge pin further have a head thereon facing outward, a slot adjacent to said respective heads, and an actuator adjacent to said respective slots.

10. The device as defined in claim 9 wherein said closure initiating means comprises a chain around said slot in said hinge pin, with one end of said chain connected to said flush device and another end of said chain connected to said activator.

11. The device as defined in claim 1 wherein said closure initiating means comprises a lever, said lever further having a pivot member pivotably connected to said mount;

a push rod connected to said flush device and to said lever; and a roller attached to said push rod, said roller adjacent to said lid such that, when said toilet is flushed, said push rod causes said lever to move forcing said roller upward and against said lid pushing said lid past a vertical equilibrium causing a gravitational descent of said lid.

12. The device as defined in claim 11 wherein said lever, from said pivot member is angled between about 90 to about 165 degrees.

13. The device as defined in claim 1 wherein said closure initiating means comprises a lever, said lever further having an aperture at one end;

a pull rod connected to said flush device and to said lever, said pull rod further having a pivot member connected to said bowl mount; and an outward laterally extending arm member attached to said pull rod, said arm member located between said aperture and said pivot member and adjacent to said lid, such that, when said toilet is flushed, said pull rod causes said lever to move forcing said arm upward and against said lid pushing said lid past a vertical equilibrium causing a gravitational descent of said lid.

14. The device as defined in claim 1 wherein said closure initiating means comprises a crank having an upstanding crank end adjacent to said lid and a pivot member connected to said mount;

a pull rod connected to said flush device and to said crank;

a lid retaining means in communication with said crank end to retain said lid in an upright position;

a first tension means under said crank situated substantially between said crank end and said pivot member adapted to force said crank end into said lid retaining means; and a second tension means connected to said bowl mount and adapted to force said lid out of its upright position such that, when said toilet is flushed, said pull rod causes said lever to release said crank end from lid retaining means further causing said second tension means to move upward and against said lid thereby pushing said lid past a vertical equilibrium causing a gravitational descent of said lid.

15. The device as defined in claim 14 wherein said lid retaining means comprises a step in said lid.

16. The device as defined in claim 14 wherein said lid retaining means comprises a detent in said lid.

17. The device as described in claim 1 wherein said closure initiating means comprises a handle is said flush device;

a handle lobe inside said handle;

a handle rod adjacent to said handle and pivotably connected to said toilet;

a first arm end and a second arm end on said handle rod;

a rod nub connected to said first arm, said rod nub in communication with said handle lobe;

a roller connected to said second arm, said roller adjacent to said lid such that when the toilet is flushed, rotation of the handle causes the handle lobe to move upward and communicate with said rod lob thereby causing said roller to abut said lid and move said lid sufficiently past its vertical equilibrium such that said lid initiates a gravitational descent.

* * * * *